United States Patent [19]

Dufrane et al.

[11] Patent Number: 5,031,538

[45] Date of Patent: Jul. 16, 1991

[54] DELAY TRAIN IGNITION BUFFER

[75] Inventors: Ronald M. Dufrane, Simsbury; Ernest L. Gladden, Granby; Robert G. Pallanck, Windsor, all of Conn.

[73] Assignee: The Ensign-Bickford Company, Simsbury, Conn.

[21] Appl. No.: 476,328

[22] Filed: Feb. 7, 1990

[51] Int. Cl.[5] ..... C06C 5/06

[52] U.S. Cl. ..... 102/275.5; 102/275.11

[58] Field of Search ..... 102/275.3, 275.4, 275.5, 102/275.6, 275.11, 202, 202.5, 202.13, 204, 205, 289

[56] References Cited

U.S. PATENT DOCUMENTS

| | | | |
|---|---|---|---|
| 3,021,786 | 2/1962 | Miller et al. | 102/275.5 |
| 3,106,892 | 10/1963 | Miller | 102/275.5 |
| 3,590,739 | 7/1971 | Persson | 102/275.5 |
| 4,742,773 | 5/1988 | Bartholomew et al. | 102/275.3 |

*Primary Examiner*—Charles T. Jordan
*Attorney, Agent, or Firm*—Hayes & Reinsmith

[57] ABSTRACT

A delay train ignition buffer (45) is positioned between a transmission tube (11) and a delay train (25) in a detonator housing (15) or a signal transmission tube housing. The buffer controls the rate at which the transmission tube temperature/pressure pulse is applied to the delay train pyrotechnic surface, attenuating the effects of the pulse with a resulting improvement in delay timing precision. The buffer also attenuates the effects of sudden depressurization within the detonator resulting from the rupture of the transmission tube or ejection of the tube from the housing, thereby preventing separation of the reacting pyrotechnic which could otherwise cause the reaction to cease at the point of separation, thus causing failure of the delay train to continue combustion of the pyrotechnic through its length.

10 Claims, 2 Drawing Sheets

SECTION A-A

DELAY TRAIN IGNITION BUFFER

TECHNICAL FIELD

This invention relates to delay trains, and more particularly to an ignition buffer for controlling the ignition of a delay train in a detonator or a time delay unit of a signal transmission tube.

BACKGROUND OF THE INVENTION

In detonating a plurality of blasting charges, it is often required that the timing of such detonations be controlled precisely. This is true, for example, in quarry blasting, where sequential delays between charges must be controlled within milliseconds. In order to control such timing of charges, transmission tubes are deployed from a central initiating point to send a signal to detonate individual blasting charges. Normally, these transmission tubes consist of one or more main trunk lines connected to a plurality of down lines.

The timing of the detonations is normally controlled by using a preselected length of signal transmission tube, such as a shock tube or deflagrating tube, connected to a detonator consisting of a housing which encloses a delay train and an explosive output charge. Where additional delay time is required, a delay unit may be inserted intermediate the transmission tube ends, as disclosed in U.S. Pat. No. 4,742,773.

The transmission tube may be of the type disclosed in U.S. Pat. No. 3,590,739, sold under the trademark "Nonel", and sometimes referred to as "shock tube". As used herein, the term "signal transmission tube" refers to any detonating or deflagrating signal transmission tube or line including a flexible hollow tube, which can carry a detonating or deflagrating signal along its interior, which signal does not destroy the tube. An alternative transmission device may consist of detonating cords and the like.

The term "signal" when used in connection with the aforementioned transmission tube is intended to refer to both the detonating shock wave or deflagrating flame front which is transmitted along the interior of the tube by combustion of the reactive substances contained therein. The detonator is activated by first initiating the transmission tube, which transmits a signal by propagating the temperature/pressure reaction down its length and into the detonator. The incoming signal ignites the delay train which contains a pyrotechnic composition that burns at a controlled rate in a linear fashion toward the opposite end, which is in contact with an explosive output charge. Where a delay train is used in a transmission tube delay unit, the opposite end of the delay train is in contact with a second section of transmission tube. The signal from the second section of transmission tube can then be used to ignite a further delay train in a detonator.

The rate at which the pyrotechnic reacts and the length of the delay train provides the designed functioning time to which the delay train was made. The rate at which the pyrotechnic burns is a function of the pyrotechnic chemical composition, and the temperature and pressure at which the composition burns.

Delay trains may be provided to operate at various functioning times by proper selection of delay train length and chemical composition. However, the reaction pressure from a transmission tube may vary, causing changes in the functioning time of the delay train. An increased pressure from the transmission tube causes an increased rate of burning, thereby resulting in a shorter than desired functioning time. Similarly, a decreased pressure from the transmission tube causes a decreased rate of burning, thereby resulting in a longer than desired functioning time.

Another problem associated with conventional delay trains is that after the transmission tube ignites the pyrotechnic of the delay train, the interior of the detonator or delay unit housing, being a closed system, becomes highly pressurized. This high pressure condition may cause rupture or ejection of the transmission tube from the housing, causing a rapid depressurization which may result in the separation of the reacting pyrotechnic from the unreacted pyrotechnic, thereby resulting in propagation failure. Such a depressurization may be so violent that the reacting pyrotechnic is physically sucked out of the delay train.

A high pressure pulse from the transmission tube may also cause variations in the effective length of the delay train. The pressure pulse may blow out a portion of the delay train pyrotechnic, or cause changes in the density of the pyrotechnic, which could alter the rate of ignition and the depth of ignition into the pyrotechnic column, thereby resulting in variations in the desired functioning time.

Variations in the functioning time of detonators and delay units in actual blasting conditions may result in out-of-sequence bore hole detonations, thereby causing increased ground vibrations and fly rock, and reduced control of fragmentation. Failure of a detonator in a blast pattern may cause the bore hole explosive to remain uninitiated and become buried and mixed with the fragmented burden. This creates a significant safety problem during digging and removal of burden which contains live explosive and a failed but still live detonator.

It is therefore an object of the present invention to provide an improved signal delay assembly for use with a detonator or a signal transmission tube delay unit.

It is another object of the present invention to provide control of the rate that pressure is applied to the delay train pyrotechnic.

It is a further object of the present invention to provide a delay assembly with a functioning time which can be accurately predicted.

It is another object of the present invention to provide a delay assembly which has improved reliability.

It is a further object of the present invention to provide a delay assembly which securely retains the reacting delay train pyrotechnic.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

A signal delay assembly constructed according to the present invention comprises a noncombustible buffer element positioned between an output end of a signal transmission tube and a delay train contained in a detonator housing or a signal transmission tube time delay unit housing; the buffer having a plurality of holes in a pattern with sufficient open space to allow a temperature/pressure pulse from the transmission tube to pass therethrough to, and cause ignition of, a pyrotechnic surface of the delay train; the buffer hole pattern having sufficiently small hole size to retain the delay train pyrotechnic and to prevent separation of reacting delay train pyrotechnic from unreacted delay train pyrotechnic, thereby preventing detonator failure and controlling delay train length, ignition temperature and functioning time. In further accord with the present invention, the buffer element must be resistant to corrosion and changes in its signal transmission characteristics, must not interact with the delay train pyrotechnic to change the pyrotechnic sensitivity, and must have sufficiently high temperature resistance to prevent burn through at the transmission tube and delay train combustion temperatures.

The buffer of the present invention controls the rate at which the transmission tube temperature/pressure pulse is applied to the delay train pyrotechnic surface, thereby significantly reducing the disruptive effects of a strong pulse on the rate of ignition and also causing ignition to occur on the surface of the delay train pyrotechnic regardless of the strength of the ignition pulse, preventing the transmission tube pressure pulse form physically blowing pyrotechnic out from the delay train, thereby controlling the delay train column length. By controlling the delay train column length and the rate that ignition pressure is applied to the delay train, the delay train functioning time can be accurately predicted.

Another advantage of the present invention is that the buffer prevents delay train pyrotechnic separation in the event of a sudden depressurization at the surface of the delay train due to transmission tube rupture or ejection, or any other sudden depressurization, thereby substantially eliminating that failure mode.

DETAILED DESCRIPTION OF CERTAIN PREFERRED EMBODIMENTS

Figure 1:
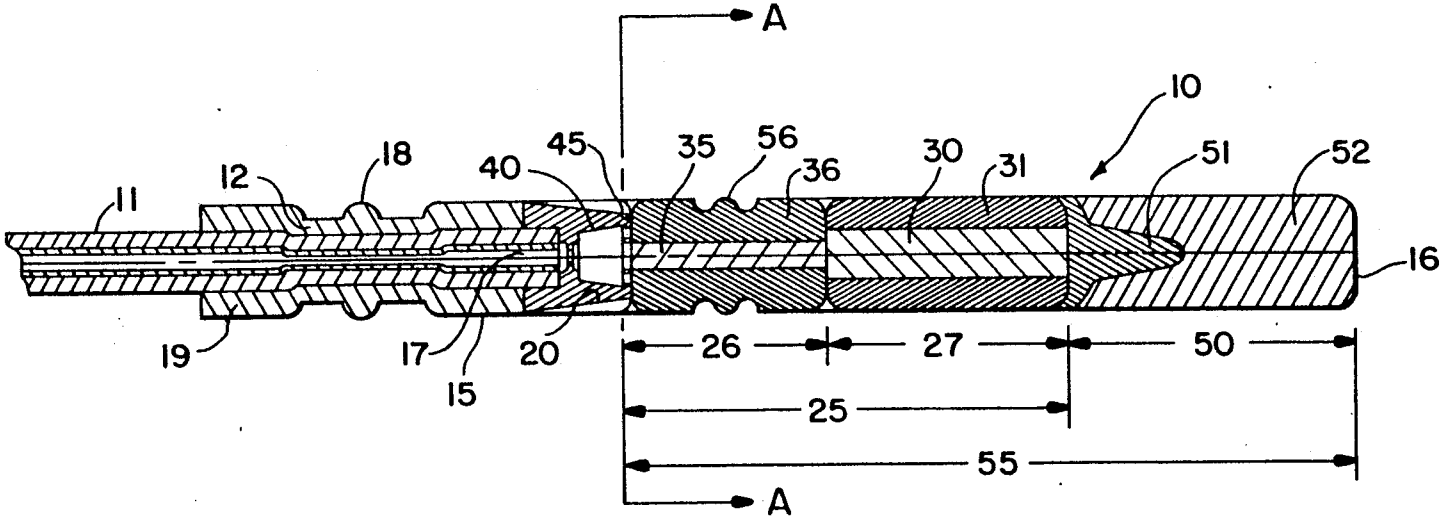
FIG. 1 is a longitudinal, cross sectional view of a detonator having a delay train ignition buffer of the present invention.

Referring to FIG. 1, a detonator 10 is shown with a signal transmission device 11, such as a shock tube (transmission tube), received in an open end 12 of a detonator housing 15. The detonator housing 15 is generally cylindrical shaped with a hollow interior and a closed end 16 opposing the open end 12. The housing 15 should possess sufficient strength to resist internal detonating and deflagrating reaction forces during combustion of signal transition compositions, and external forces which may be applied in field use. The preferred material is aluminum tubing.

An end of the transmission tube 17 is secured firmly in the housing by crimping the housing near the open end 18. This crimping action secures the housing against the transmission tube exterior to hold the tube in place without crushing or otherwise interfering with signal propagation within the transmission tube. An elastomeric material may be employed as a bearing 19 between the housing and the transmission tube in the crimped region.

The interior of the housing 15 forms a chamber 20 in which a signal delay assembly (delay train) 25 is disposed. The delay train 25 and the chamber 20 are both preferably cylindrical in shape and are correspondingly configured to fit tightly together. The tight fit prevents direct signal communication between opposing ends of the delay train 25. The delay train 25 comprises a transition element 26 and a delay element 27.

The delay element 27 contains a shaped delay composition 30 inside a metal tube 31, e.g., lead. The delay composition may be of any known in the art, for example, a mixture of silicon and lead dioxide ($PbO_2$); silicon and red lead oxide ($Pb_3O_4$); silicon, red lead oxide ($Pb_3O_4$) and barium sulfate ($BaSO_4$); tungsten, potassium perchlorate ($KClO_4$) and barium chromate ($BaCrO_4$); molybdenum and potassium perchlorate ($KClO_4$); and mixtures thereof.

The delay element 27 functions to control the rate of combustion from one side of the element to the other. The time interval required for combustion to propagate from one side of the delay element to the other is preselected and may range from nine milliseconds to ten seconds or longer, depending on the delay composition utilized.

The transition element 26 contains a shaped transition composition 35 packed inside a metal tube 36, e.g., lead. The transition element is placed directly adjacent to and abutting the delay element 27 to receive and transmit a blasting initiation signal between the end of the transmission tube 17 and the delay element 27.

The transition composition 35 is a mixture of oxidizing and reducing agents which may be ignited by a signal from a transmission tube to exothermally react to produce sufficient heat energy to ignite the delay composition 30. The aforedescribed delay compositions generally will not function well as a transition composition. Suitable transition compositions include a mixture of silicon and red lead oxide ($Pb_3O_4$); zirconium and potassium perchlorate ($KClO_4$); titanium and potassium perchlorate ($KClO_4$); boron and red lead oxide ($Pb_3O_4$); zirconium and iron (III) oxide ($Fe_2O_3$); zirconium and potassium chlorate ($KClO_3$); zirconium and lead chromate ($PbCrO_4$); titanium and lead chromate ($PbCrO_4$); magnesium and barium chromate ($BaCrO_4$); boron and potassium nitrate ($KNO_3$); and mixtures thereof.

An alignment cup 40 may be employed at the transmission tube end 17 to direct the transmission tube signal between the transmission tube and the transition element.

Figure 2:
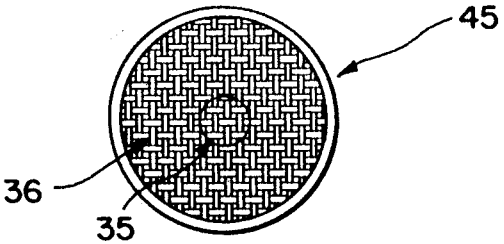
FIG. 2 is an enlarged, cross sectional view of the ignition buffer taken on line A—A of FIG. 1.

An ignition buffer 45 is positioned between the alignment cup 40 and an input end of the delay train 25 having the transition element 26 within the detonator housing 15. The buffer 45 is preferably pressed into the end of the delay train 25. The buffer may consist of a wire-cloth screen, as shown in FIG. 2, or other noncombustible materials such as sintered metal, porous ceramic, or perforated metal. The buffer material must be resistent to corrosion and changes in signal transmission characteristics. In addition, the buffer material must not chemically interact with the transition composition to either decrease its sensitivity causing ignition failures, or increase its sensitivity to ignition by static electrical charge or impact. The buffer must also have a sufficiently high temperature resistance to prevent burn through resulting from the transmission tube impulse or the preliminary reaction heat from ignition of the transition composition. The buffer material must have sufficient open space in its pattern to allow the temperature/pressure pulse from the transmission tube 11 to pass through to the transition composition 35. In addition, the material must have sufficiently small spaces in its pattern to retain the compositions of the delay train, and to prevent separation of the compositions in the event of a sudden depressurization due to transmission tube rupture or ejection. The buffer acts as a filter, controlling the rate at which pressure is applied to the transition composition to cause ignition, thereby minimizing disruption and allowing only surface ignition. Experimentation has shown that wire-cloth screens with a mesh size in the range of 60 to 120 mesh are particularly well suited for use as a buffer element. A mesh size of less than 20 mesh may not have sufficient mechanical integrity to retain its shape, and the wire ends may fray. Screen having a mesh size finer than 325 mesh may not possess desirable signal transmission characteristics.

A explosive portion 50 is located adjacent to and abutting the delay element 27. The explosive portion 50 consists of a primer charge 51 and a base charge 52.

The primer charge 51 insures signal transmission from the delay composition 30, and converts the temperature/pressure signal into a detonation signal for initiating the base charge 52. The primer charge 51 is made of a primary explosive, such as lead azide, to ensure signal transmission and detonation.

The base charge 52 provides a detonation signal, in response to the detonation of the primer charge 51, sufficient to initiate detonation and explosion of a bore hole explosive charge or other explosive devices. The base charge 52 comprises a high-velocity explosive, such as pentaerythritol tetranitrate (PETN).

After insertion of the explosive portion 50 and the delay train 25 into the detonator housing 15, the blasting cap assembly 55 is secured firmly in the housing 15 by crimping the housing in the area 56 corresponding to the internal location of the transition element. This crimping action secures the housing against the transition element lead tube 36 to hold the blasting assembly 55 in place without crushing or otherwise interfering with ignition and burning of the transition composition.

In normal operation, an incoming signal will be transmitted from the transmission tube 11, through the alignment cup 40 and the ignition buffer 45, to the transition element 26. The signal is in the form of a pulsed shock wave and/or flame front, and is focused at the transition composition 35 by the alignment cup. The ignition buffer 45 controls the rate that pressure is applied to the transition element, and limits ignition of the transition element to surface ignition. In the event of a transmission tube rupture or ejection, or any other sudden depressurization, the buffer retains the transition composition and the delay composition, thereby preventing detonator failure.

Combustion of the transition composition 35 from the transmission tube side to the delay element side of the transition element occurs preferably in less than about 80 milliseconds. The combustion of the transition composition 35 then ignites the delay composition 30. The time required for combustion of the delay composition 30 from one side of the delay element to the other side is preselected, ranging from about 150 milliseconds to 10 seconds, depending on the particular delay element and composition employed.

At the end of the preselected delay element combustion time, the primer charge 51 is ignited. The highly active primer charge rapidly detonates, detonating the base charge 52. The base charge in turn rapidly detonates, detonating the bore hole explosive charge.

Although the buffer is illustrated as being used in a detonator, it would work equally as well in a signal transmission tube delay unit, such as the delay unit disclosed in the aforementioned U.S. Pat. No. 4,742,773, the disclosure of which is hereby incorporated by reference. In addition, although the ignition buffer is described as preferably being pressed into the delay train, it is expected that the advantages of the present invention would be realized with an ignition buffer attached to the inside wall of the detonator housing, affixed to the alignment cup, or any other suitable mounting and retaining arrangement. The advantages of the present invention may also be realized where the buffer is simply placed between the alignment cup and the transition element. If an alignment cup is not utilized, the buffer is positioned between the transmission tube end and the transition element.

Figure 3:
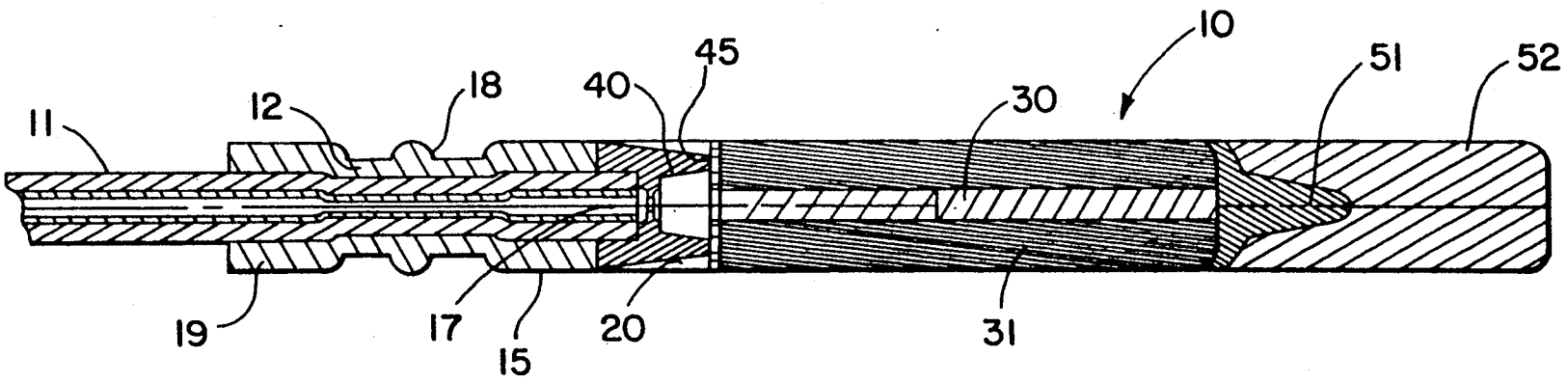
FIG. 3 is a longitudinal, cross sectional view of an alternative embodiment of the detonator of FIG. 1.

A transition element is not required in all detonators and signal transmission tube delay units. The function of the transition element is to ignite the next elements of the delay train which may not in themselves be sufficiently sensitive to be ignited directly from a transmission tube. Delay trains with a very short functioning time usually utilize a fast burning delay composition which is sensitive enough to be ignited from a transmission tube, thereby eliminating the need for a transition element, as shown in FIG. 3. Where such fast burning delay composition is used, a typical delay is from about 9 milliseconds to 150 milliseconds. However, as the delay train functioning time requirement becomes longer, a length of the faster type delay composition is required which is greater than can physically fit into the detonator or delay unit housing. At this point, the delay composition is changed to a composition which burns slower, allowing a shorter delay element. However, because of the reduced reactivity of the new delay composition, its ignition sensitivity to allow reliable direct ignition from the transmission tube has been lost, therefore a transition element is required. It has been found that in some instances a starter element may be required between the transition element and the delay element. The starter element is highly exothermic producing sufficient heat to cause ignition of the delay element.

In detonators which do not utilize a transition element, the ignition buffer is placed between the delay element and the alignment cup. As previously described, the buffer may be pressed into the delay element, attached to the alignment cup, attached to the detonator housing, or simply placed between the alignment cup and the delay element.

Although the invention has been illustrated and described with respect to exemplary embodiments thereof, it should be understood by those skilled in the art that the foregoing and various other changes, omissions and additions may be made therein and thereto, without departing form the spirit and scope of the invention.

We claim:

1. A signal delay assembly, for use with a blasting signal transmission device, comprising:

a housing;

a delay train, positioned within said housing, including a pyrotechnic composition for transmitting a blasting initiation signal to provide a preselected time delay from a first side of said delay train to a second side of said delay train; and a buffer element, positioned between an input end of said housing and said delay train first side for allowing signal transmission while controlling the rate that pressure is applied to said delay train and for retaining said pyrotechnic composition in the event of rupture of said transmission device or ejection of said transmission device from said housing.

2. The signal delay assembly of claim 1 wherein said buffer element further comprises a pattern having a plurality of holes, said pattern having sufficient open space to allow said blasting initiation signal to pass through to, and cause ignition of, said pyrotechnic composition, said pattern having sufficiently small hole size to retain, and prevent separation of, the pyrotechnic composition in the event of rupture of said transmission device or ejection of said transmission device from said housing.

3. The signal delay assembly of claim 1 wherein said buffer element is substantially inert, resistant to changes in signal transmission characteristics, resistant to burn through at the combustion temperature of said transmission device and the combustion temperature of said pyrotechnic composition, and not chemically reactive with said pyrotechnic composition.

4. The signal delay assembly of claim 1 wherein said buffer element is a wire-mesh screen with a mesh size between 20 and 325 mesh.

5. The signal delay assembly of claim 1 wherein said delay train comprises a transition element and a delay element, said transition element including a transition composition for transmitting a blasting initiation signal from a first side of said transition element to a second side of said transition element, said transition element first side being adjacent to said buffer element, and said delay element including a delay composition for transmitting said signal at a preselected time from a first side of said delay element to a second side of said delay element, said delay element first side being adjacent to said transition element second side.

6. The signal delay assembly of claim 1 wherein said buffer element is pressed into said delay train first side.

7. The signal delay assembly of claim 1 wherein said housing comprises a detonator housing having an open end for receiving said blasting signal transmission assembly, and a closed end opposite said open end.

8. The signal delay assembly of claim 7 further comprising a blasting portion, adjacent to said delay train second side within said detonator housing, for igniting said blasting portion after said preselected delay time.

9. The signal delay assembly of claim 1 wherein said housing comprises a blasting signal transmission device delay unit housing, having a first open end for receiving said blasting signal transmission device, and a second open end for receiving a second blasting signal transmission device.

10. A signal delay assembly, for use with a blasting signal transmission device, comprising:

a detonator housing having an open end for receiving said blasting signal transmission device, and a closed end opposite said open end;

a transition element, positioned within said detonator housing, including a transition composition for transmitting a blasting initiation signal from a first side of said transition element to a second side of said transition element;

a delay element including a delay composition for transmitting said signal at a preselected time from a first side of said delay element to a second side of said delay element, said delay element first side being adjacent to said transition element second side within said detonator housing;

a blasting portion, adjacent to said delay element second side within said detonator housing, for igniting said blasting portion after said preselected delay time; and a buffer element, positioned between said detonator housing open end and said transition element first side within said detonator housing for controlling the rate that pressure is applied to said transition element and for retaining said transition composition and said delay composition in the event of rupture of said transmission device or ejection of said transmission device from said housing.

* * * * *